US005762230A

United States Patent [19]

Policappelli

[11] Patent Number: 5,762,230

[45] **Date of Patent: *Jun. 9, 1998**

[54] LAMINATED CONTAINER

[76] Inventor: Nini Policappelli, 361 N. Robertson Blvd., Los Angeles, Calif. 90048

[ * ] Notice: The term of this patent shall not extend beyond the expiration date of Pat. No. 5,586,681.

[21] Appl. No.: 524,089

[22] Filed: Sep. 7, 1995

Related U.S. Application Data

[63] Continuation-in-part of Ser. No. 378,461, Jan. 26, 1995, Pat. No. 5,586,681, which is a continuation-in-part of Ser. No. 29,791, Mar. 11, 1993, abandoned.

[51] Int. Cl.[6] ..... B65D 8/06; B65D 8/12; B65D 25/14; B65D 25/54

[52] U.S. Cl. ..... 220/461; 220/662; 220/666; 220/669; 220/674; 220/906

[58] Field of Search ..... 220/669, 903, 220/906, 460, 667, 441, 676, 662, 468, 665, 453, 461, 666, 674; 229/403, 3.5 MF; 215/395; 138/153, 147, 106, 113; 206/459.5

[56] References Cited

U.S. PATENT DOCUMENTS

| | | | |
|---|---|---|---|
| 343,133 | 6/1886 | Leighton et al. | 215/382 |
| 397,163 | 2/1889 | Zinsser, Jr. | 220/408 |
| 1,073,897 | 9/1913 | Goss | 215/12.1 |
| 2,715,089 | 8/1955 | Michener et al. | 229/3.5 MF |
| 2,932,437 | 4/1960 | Wilcox . | |
| 3,356,209 | 12/1967 | Pezely, Jr. | 220/441 X |
| 3,825,151 | 7/1974 | Arnaud . | |
| 3,940,001 | 2/1976 | Haefner et al. | 220/460 X |
| 4,155,474 | 5/1979 | Bizzarri . | |
| 4,572,412 | 2/1986 | Brach et al. . | |
| 4,609,113 | 9/1986 | Seki | 220/906 X |
| 4,645,078 | 2/1987 | Reyner . | |
| 4,700,867 | 10/1987 | Dutt et al. | 220/410 |
| 5,070,801 | 12/1991 | Frederick . | |
| 5,158,190 | 10/1992 | Sosenko . | |
| 5,174,469 | 12/1992 | Policapelli | 220/667 X |
| 5,203,490 | 4/1993 | Roe | 229/403 X |
| 5,299,700 | 4/1994 | Beniacar | 215/395 X |

FOREIGN PATENT DOCUMENTS

| | | |
|---|---|---|
| 661255 | 7/1929 | France . |
| 668757 | 10/1964 | Italy . |
| 2 266 290 | 10/1993 | United Kingdom . |

*Primary Examiner*—Allan N. Shoap
*Assistant Examiner*—Niki M. Kopsidas
*Attorney, Agent, or Firm*—Merchant, Gould, Smith, Edell, Welter & Schmidt

[57] ABSTRACT

A container is provided with grip enhancing protrusions of various shapes and sizes, which are raised and integrally formed on the container. The surface provides protrusions to enhance the ornamentation. The container is formed of two body portions which are laminated. The first body portion is of a flexible material which could formed of aluminum or plastic, and protrudes through protrusions provided in the second body portion which could be formed of a more solid material. The second body portion may be of a metal, cellulose, or plastic material.

18 Claims, 10 Drawing Sheets

LAMINATED CONTAINER

RELATED APPLICATIONS

This application is a continuation-in-part of application Ser. No. 378,461 filed Jan. 26, 1995, and now issued as Pat. No. 5,586,681 on Dec. 24, 1996, and which is a continuation-in-part of application Ser. No 29,791 filed Mar. 11, 1993, and now abandoned. The contents of the related applications are incorporated by reference herein.

BACKGROUND

This invention relates to an enhanced container for fluids.

In particular, this invention relates to a can for beverages. The can is physically relatively stronger, and can be relatively larger than a standard size can. Further, the container can provide a relatively enhanced construction for temperature conduction and also be relatively more attractive than existing cans.

The invention also relates to a container using a combination of materials for its construction which is environmentally and economically advantageous.

Traditional beverage containers typically have smooth cylindrical surfaces, the container being of a size that can easily be grasped by a user. However, because containers of beverages are often immersed in ice coolers, or naturally accumulate condensation, which renders the outer surface slippery to handle, containers can become difficult to hold.

Moreover, in an attempt to keep the container of a size that can easily be held by a normal user, the beverage container is often relatively tall, to ensure that the proper amount of volume is maintained. The additional height of each beverage container can, cumulatively, cause storage problems as each beverage container takes up additional vertical space.

There is a need for a beverage container having a surface that offers a better grip to the user, while permitting the height of the beverage container to be relatively shorter, to make more efficient use of storage space.

There is also a need to have a container which has inherent insulating characteristics, so as to provide thermal insulation between the user and the container. Because many containers of the aluminum variety conduct heat freely, it would be advantageous to have a beverage container which actually decreases conduction.

It would be advantageous to provide a beverage container having unique visual effects and be environmentally and economically efficient, and which would distinguish the product over others.

SUMMARY

The present invention provides a can which seeks to minimize the disadvantages presented by the prior art.

By this invention, there is a provided a container which has at least the sides formed by two body portions. The first body portion is a relatively flexible material and the second body portion is a relatively more solid material and fits about the first body portion. The first body portion and second body portion are in a mating relationship which, preferably, forms a relatively laminated structure.

By the term "laminated" the Applicant means a bonding process where two or more layers are combined into a firmly united material. The superposed layers may also be bonded with an appropriate resin or glue. Preferably, the bonding is effected under heat or vacuum by a compression process.

The container may be formed by a punching process which is performed either hot or cold and with the two materials forming the first body portion and the second body portion so that the materials effectively become sealed together. The laminated container provides an appropriate look, structure and texture.

The first body portion has first and second ends and there is a bottom portion sealing the first end and a top portion sealing the second end and having an aperture. A cover member is releasably secured to the top portion seals the aperture thereby providing a closed cavity for containing fluid.

The first body portion cooperates with the second body portion to provide a pattern of apertures in the second body portion, which are filled by the first body portion and which can be protrusions formed by the first body portion through the apertures. The apertures and protrusions when they are present are of a preselected shape, height configuration and arrangement. The protrusions are formed through apertures provided in the second body portion and the protrusions extend outwardly from the second body portion. When the first material extends through the apertures they appear essentially as bubbles extending from the surface of the second body portion. By having the first material as an essentially transparent nature the contents of the container can be viewed through the apertures and the protrusions. Further, by having the composite first and second body portions or at least the second body portion sufficiently rigid any kind of printing can be effected to the surface of at least the second body portion. The printing can also cover those portions of the first body portion that extend in or through the apertures of the second body portion.

By having the apertures in the second body portion extend for about 50 of a surface formed by the second body portion, the protrusions extend for about 50% of the effective surface of the second body portion.

This combination of a first body portion of a first material and a second body portion of a second material creates a container which is unique.

There is an efficient use of a first material and a second material respectively for the first body portion and second body portion. In some cases these materials may be the same kind of materials but may be simply of different colors or different consistencies or rigidities. Thus, a first form of plastic can form the first material for the first body portion and a second form of plastic a second material for the second body portion.

In other forms of the invention, the first body portion can selectively be formed from a plastic, cellulose or a metallic material, and the second body portion from a plastic, cellulose or a metallic material.

In a preferred form of the invention, the second body portion acts effectively as a shirt and provides the rigidity to the container and the first body portion which would be flexible. As such, the first body portion can extend outwardly under the effect of a fluid or liquid contents of the container.

The first body portion can be formed of the material which is relatively transparent or clear. This provides a means for visually determining the contents of the material and in the container, and its quantity in the container.

A suitable lamination means may be provided to effectively bond the first material for the first body portion and the second material for the second body portion together.

Further according to the invention the exterior of the container is provided with various protrusions integral with the container, which provide additional grip so that the container can be better held when wet or cold. The protrusions can be of any shape, and any texture, and can be randomly interspersed throughout the perimeter of the container, or organized in a pattern. The effect of these protrusions is to increase the volume of the container and to provide proper gripping means.

The increase in volume provided by the protrusions also facilitates the manufacture of containers of a shorter height, if it is desired to retain the same volume for the standard container. Because the protrusions provide the proper gripping means, and also increase the volume of the container, the container can be made shorter. The containers can also be made wider without affecting the user's ability to grasp the container properly as the protrusions actually enhance the grippability of the container. By making the containers slightly shorter than a standard shape container, the containers can be more efficiently stored and/or displayed, especially in refrigerator display units having limited height.

In addition, the protrusions are situated around the perimeter of the container such that less heat is conducted between the user's hand and the container. Because the user's hand comes into contact primarily with the protrusions, which have limited surface area, less surface area contact between the user's hand and the container is provided. Not only does this help prevent the cold liquid in the container from being heated by conduction from the user's warm hands, but also helps prevent the cold temperature of the liquid in the container from being transferred by direct conduction to the user's hand, providing more comfort to the user.

In addition, these protrusions can be made in any shape or texture, including shapes identifying the product with the consuming public, including logos, trademarks, trade names and lettering. The protrusions are preferably a shape selected to be at least one of repetitive triangle, star, rectangle, circle or recognizable form.

The body of the container includes an outside surface which includes a layer which can be a printing of an ornamental representation on the outside surface. The ornamental representation extends at least in part over the protrusions thereby to enhance the ornamental effect of the surface by providing a three-dimensional or embossing effect of the ornamentation on the surface.

According to one embodiment of the present invention, the upper portion of the fluid container is collapsible, preferably due to its construction at this location which is corrugated or accordion-like. The corrugation of the surface of the container at this location allows it to be manually collapsed by the consumer. Furthermore, the accordion-like construction of the collapsible portion of the container of the present invention can be located anywhere on a particular container. For example, the collapsible portion may be found on the bottom, sides, or center of the container.

The invention applies to all types of containers having various configurations and materials. For example, these principles apply equally well to containers having circular, square, or rectangular, cross-sectional configurations. They also apply to a variety of container materials, such as aluminum, plastic, glass, or cardboard paper.

The container of the present invention has applications in a number of industrial, consumer, and recreational settings, and should not be considered limited to the specific embodiments shown in the drawings or described herein.

DRAWINGS

Figure 17:
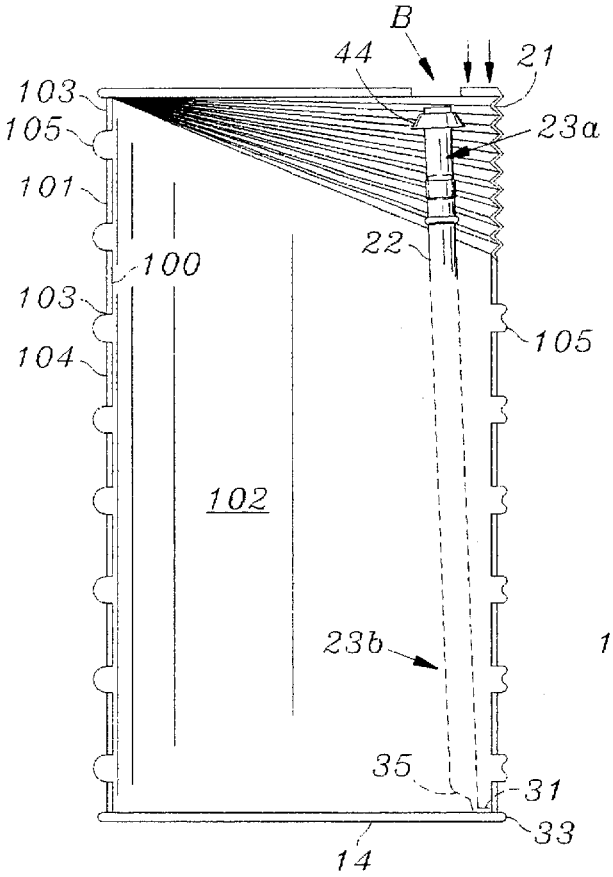
FIG. 17 is a cross-sectional side view of a container having a first body portion and a second body portion. There is a first kind of protrusion formed by the first body portion extending through apertures provided on the second body portion.
Figure 18:
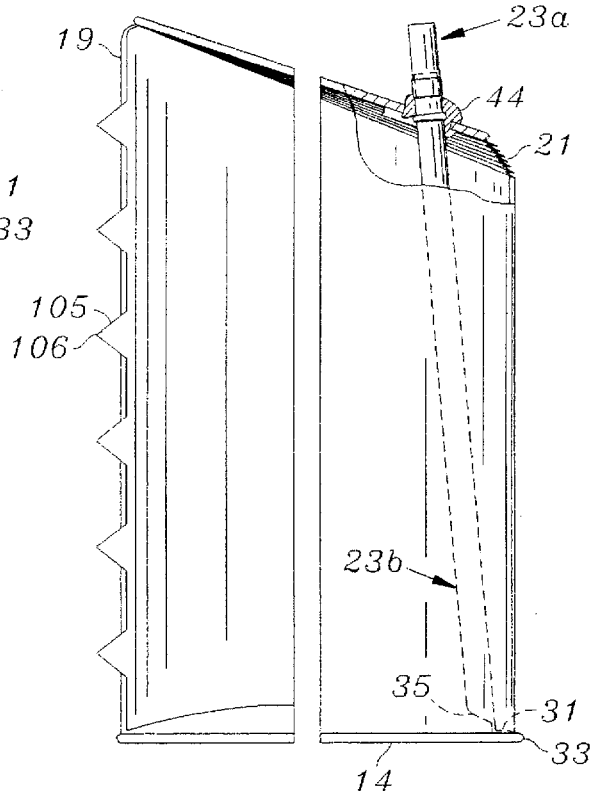

FIG. 18 is a cross-sectional side view of a container having a first body portion and a second body portion. There are different protrusions formed by the relative to those illustrated in FIG. 17. The can is shown in a partly collapsed form so that it internally contained straw protrudes from the top portion of the container.

Figure 19:
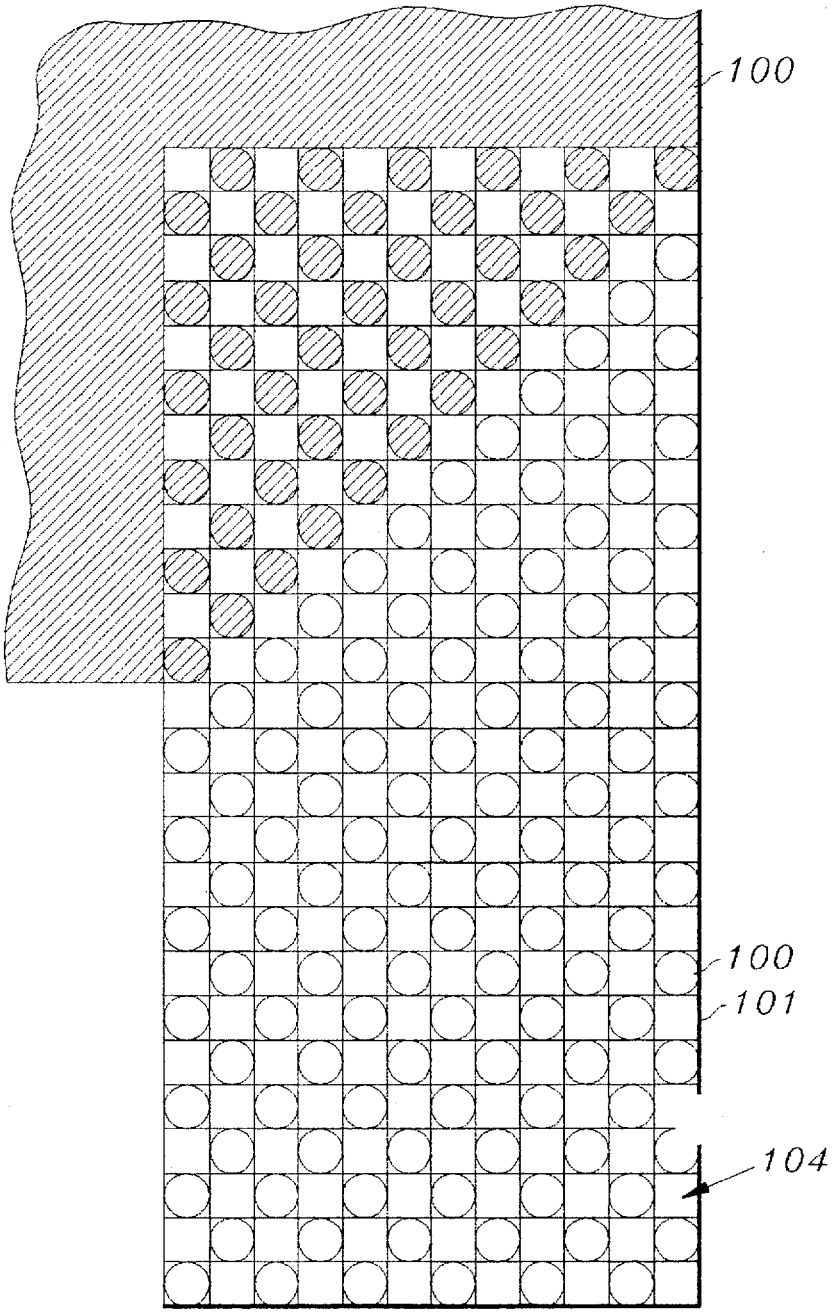

FIG. 19 is a side view representation of an opened structure showing a first body portion and a second body portion. There are different apertures in the second body portion through which the first body portion protrudes.

FIGS. 20A to 20D illustrate different side views of cans for fluids.

Figure 21:
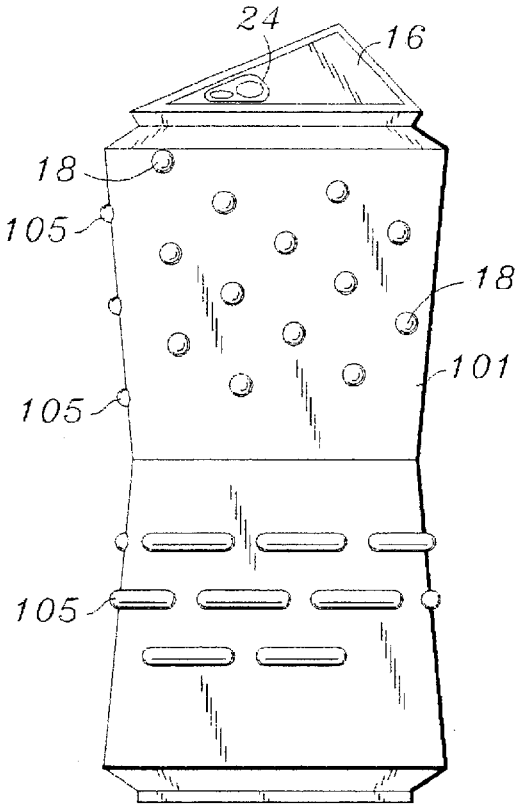

FIG. 21 illustrates a perspective view of a triangulated cross sectional view of a can in accordance with the invention.

Figure 22:
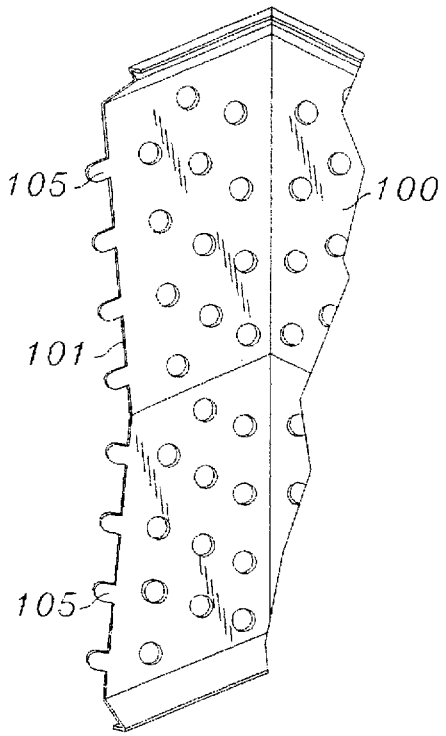

FIG. 22 illustrates a partial exploded view of a triangulated can with the first and the second body portions shown in laminated relationship.

Figure 23:
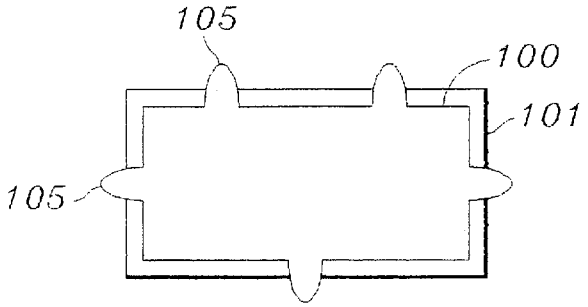
Figure 24:
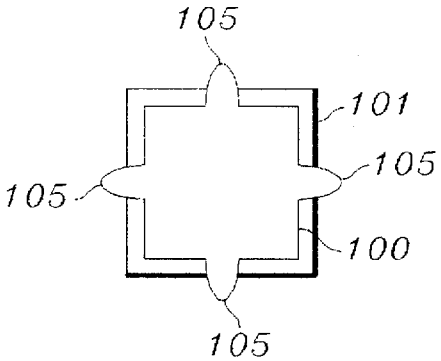
Figure 25:
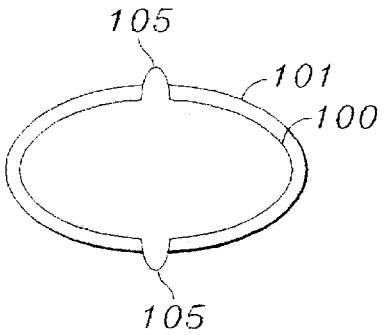

FIGS. 23 to 25 illustrate different cross-sectional end views of respectively a rectangular can, square can and an oval can with the first and the second body portions shown in laminated relationship.

DESCRIPTION

Figure 1:
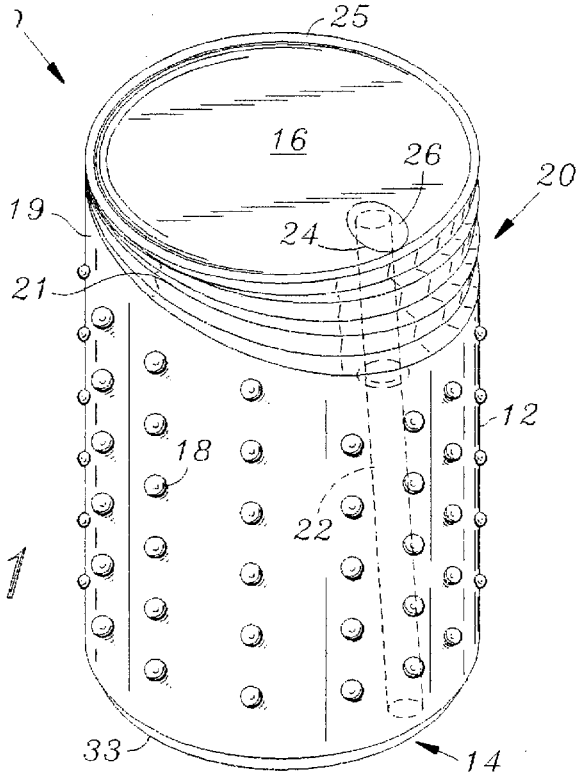
FIG. 1 is a perspective view of a container or beverage can of substantially standard size in diameter relative to height constructed in accordance with the principles of the present invention illustrating a corrugated, collapsible portion near the upper surface of the container.

Referring to FIG. 1, there is shown a container 10 constructed in accordance with the present invention, including an exterior collapsible cylindrical surface 12, a bottom surface 14 and a top surface 16. A rigid upper rim 25 connects the top surface 16 with the cylindrical side 12, and, in a similar fashion, a rigid lower rim 33 connects the cylindrical side to the bottom surface 14. Although the invention is illustrated in connection with a cylindrical container, the principles of the present invention, as pointed out above, are equally applicable to containers of all configurations and dimensions, and should not be construed as being limited to those shown in the drawings. Also shown on the exterior of the cylindrical side surface of the container are raised protrusions 18 which provide several advantages, as described more fully below.

Shown in FIG. 1 is a collapsible portion 20 of the container 10 located near the top surface 16. This collapsible portion 20 can be manually manipulated by the consumer to reveal a drinking straw 22, shown in dashed lines in FIG. 1. The collapsibility of this portion 20 of the container 10 is provided by the nature of its construction in which it is structurally less rigid on the vertical axis than the other portions around the circumference of the container side 12. This decreased rigidity can be provided in a number of ways, for example, by providing a plurality of corrugations 21 in the container side 12, in an accordion-like fashion, as shown in FIG. 1.

Figure 2:
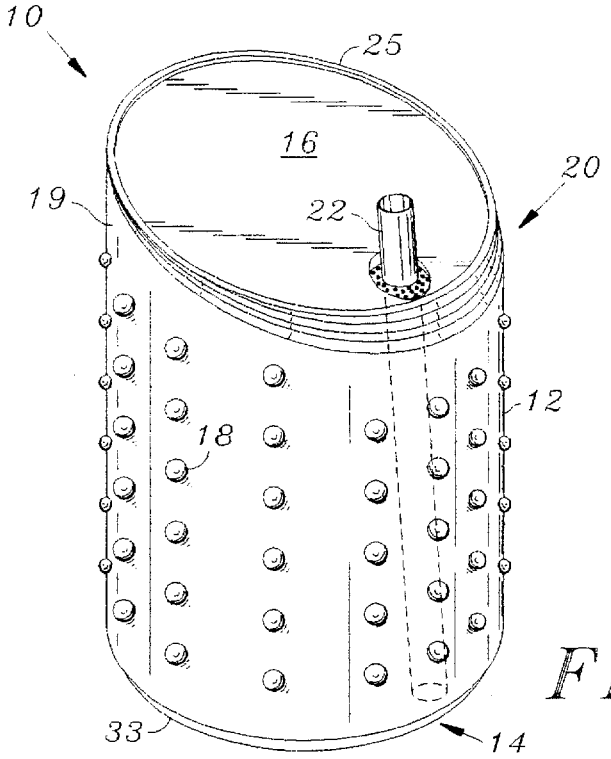
FIG. 2 is a perspective view of a container of the present invention in its collapsed state illustrating the exposure of a drinking straw for consumer use.

Preferably, the corrugated portion 20 is arranged at a downward angle along one side of the container 10 so that in its collapsed state, as shown in FIG. 2, the container top surface 16 becomes inclined. This inclined nature of the container corrugated portion 20 provides for vertical structural rigidity along a non-corrugated side 19 of the container 10, as shown in FIG. 1. Additionally, in one embodiment, the drinking straw 22 is mounted within the container 10 on the opposite corrugated side so as to act as a vertical strut or support when the container is in its non-collapsed state, as will be described further below. This permits the container 10 of the present invention to be stacked, packaged and handled like other containers as is common in the beverage industry, without resulting in premature collapse.

Shown on the top surface 16 of the container 10, as illustrated in FIG. 1, is an opening 24. In the original construction of the container 10, the opening 24 is closed or sealed by a portion of material comprising a cover 26 having the same configuration as the opening 24. This cover 26 is attached to the opening 24 on the container 10 by any means sufficient to cause a weakened state around the periphery of the cover which can be readily penetrated. For example, the opening 24 can preferably be formed simply by perforating the container top 16 in the configuration of the opening so that the perforations weaken the attachment of the cover 26 to the container.

Figure 3:
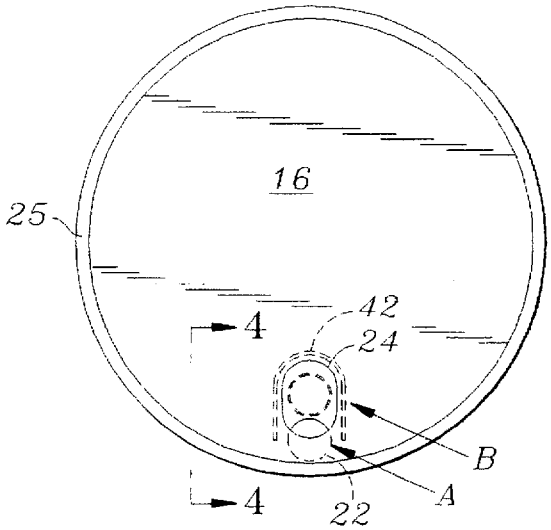
FIG. 3 is a top view of the container of the present invention illustrating the different positions of the drinking straw.
Figure 4:
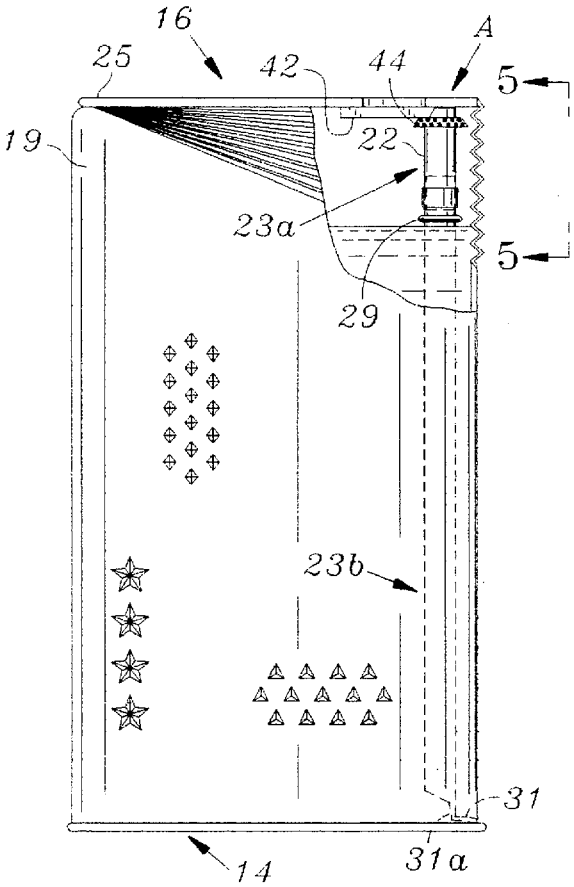
FIG. 4 is a partial cut-away side view of the container of FIG. 3 taken from line 4—4, illustrating the container before collapsing with the straw in its shipping position. Also illustrated are several possible shapes of protrusions integral with the exterior of the container.
Figure 6:
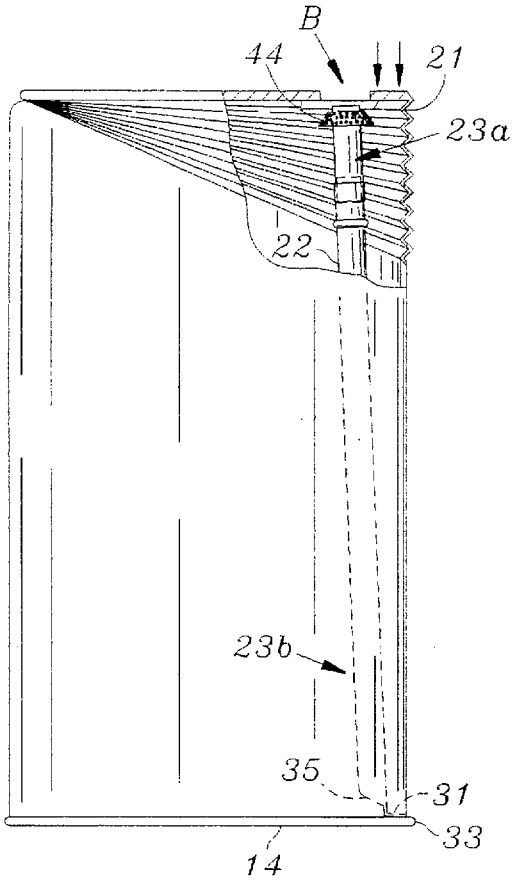
FIG. 6 is a partial cut-away side view of the container of FIG. 3 taken from line 4—4, illustrating the container just prior to collapsing with the straw moved into a position under the opening at the top of the container.
Figure 11:
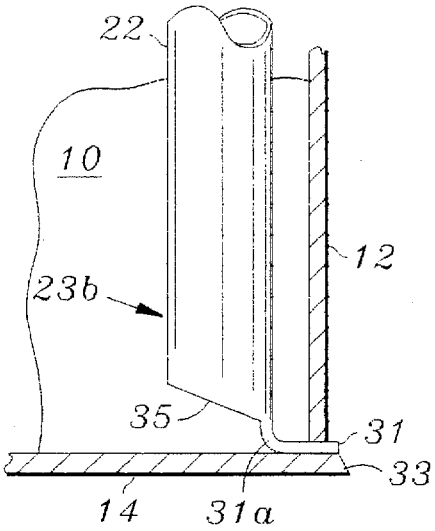
FIG. 11 is a partial view of the bottom end of the drinking straw illustrating the fixing and support tab connected to the bottom end of the container.
Figure 12:
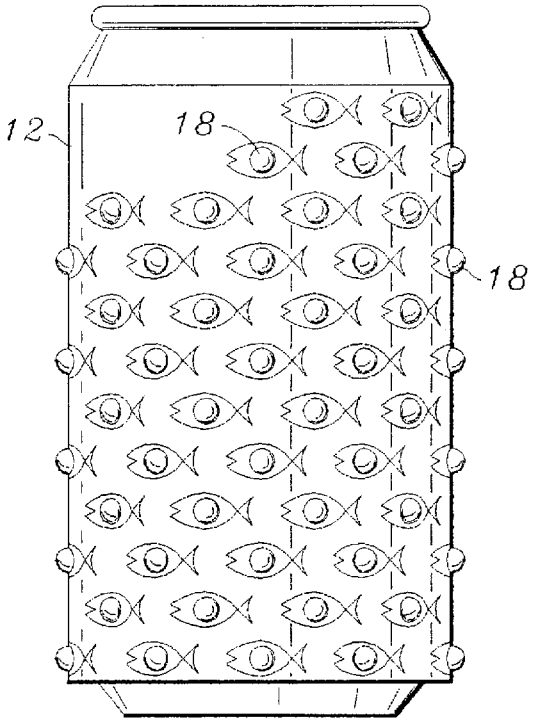
FIG. 12 is front view showing a standard can with an repetitive fish art work ornamental design on the surface.
Figure 13:
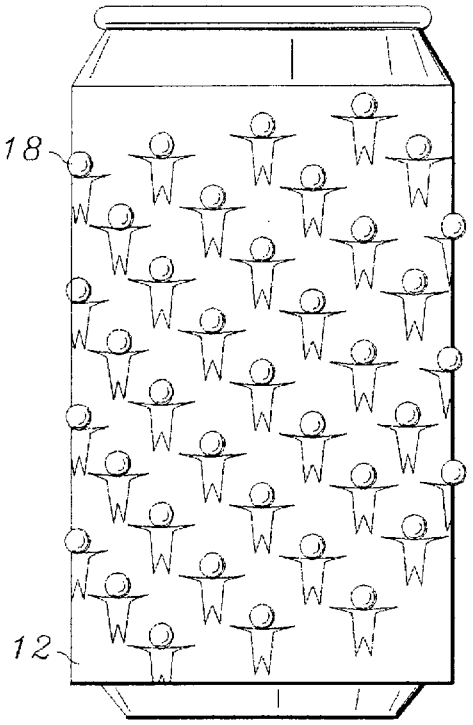
FIG. 13 is front view showing a standard can with an repetitive human figure art work ornamental design embossed on the surface.
Figure 14:
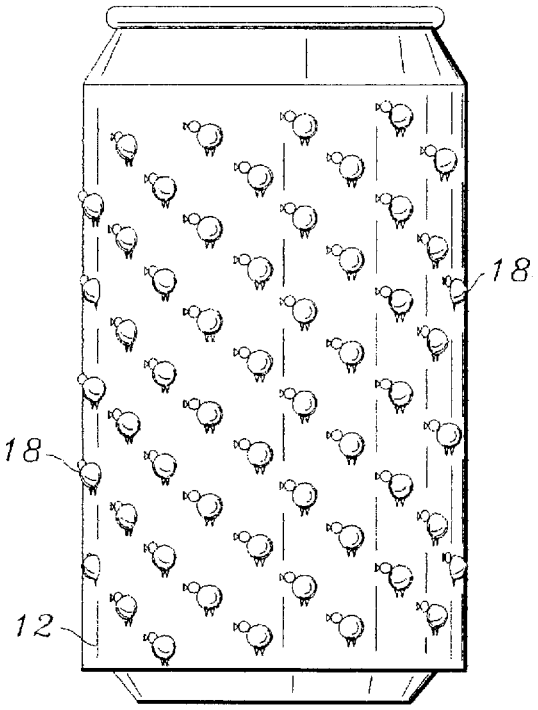
FIG. 14 is front view showing a standard can with an repetitive sheep art work ornamental design embossed on the surface.
Figure 15:
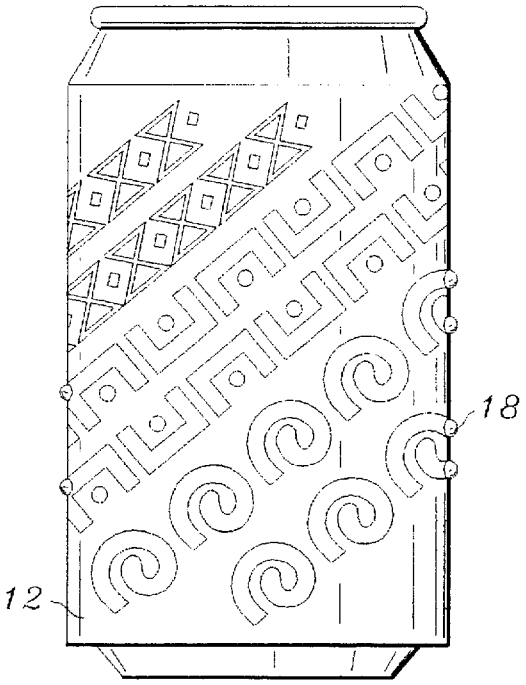
FIG. 15 is front view showing a standard can with an printed layer repetitive art work ornamental logo and pattern design embossed on the surface.

Referring to FIG. 3, an upper portion **23*a* of the drinking straw 22 has two primary positions A and B. These two positions are also shown in FIGS. 4 and 6. Initially, the upper portion 23*a* of the drinking straw 22 is at A, proximate and parallel to the interior of side 12 of the container 10. The edge of the opening 24 is disposed slightly radially inward of the container rim 25 such that in position A, the upper portion 23*a* of the drinking straw 22 will contact the interior of the top surface 16 directly between the opening and the upper rim. Preferably, the lower portion 23*b* of the straw 22 is pivotally mounted adjacent the interior of the bottom surface 14 by means of an extended hinge tab 31, as shown in FIGS. 4 and 11. Preferably, this attachment provides some pivoting movement at a bend 31*a* while preventing vertical movement. The straw 22 is itself constructed from a relatively rigid material so as to be capable of structurally supporting the corrugated section 20 of the container 10** when subjected to normal vertical loads such as those experienced during shipping and distribution.

As shown in FIG. 3, the straw 22 can be moved to the second position B by pressing radially inward on the container side surface 12 nearest the straw. The upper portion **23*a* of the drinking straw 22 is laterally moved away from the side as it pivots about its lower end 23*b*, and into a position directly below the opening 24 (also seen in FIG. 6). A raised U-shaped ridge 42 adjacent the opening 24 on the inside surface of the container top 16 prevents the straw 22 from being pushed past the opening. In this regard, the straw 22 may be moved into position beneath the opening 24 between the legs of the U-shaped ridge 42 and thus be constrained from further movement by the closed end of the ridge. At the same time, the straw 22 is allowed to hinge at its lower portion 23*b* and rotate slightly. Once the drinking straw 22 is in position, it is rigid enough to be capable of penetrating the weakened opening 24 on the container top 16. The rigidity of the drinking straw 22 allows the container 10 to be shipped without risk of the container prematurely collapsing, yet its pivoting connection provides for movement of the straw to facilitate puncture of the opening 24 and collapse of the corrugated section 20**.

Figure 7:
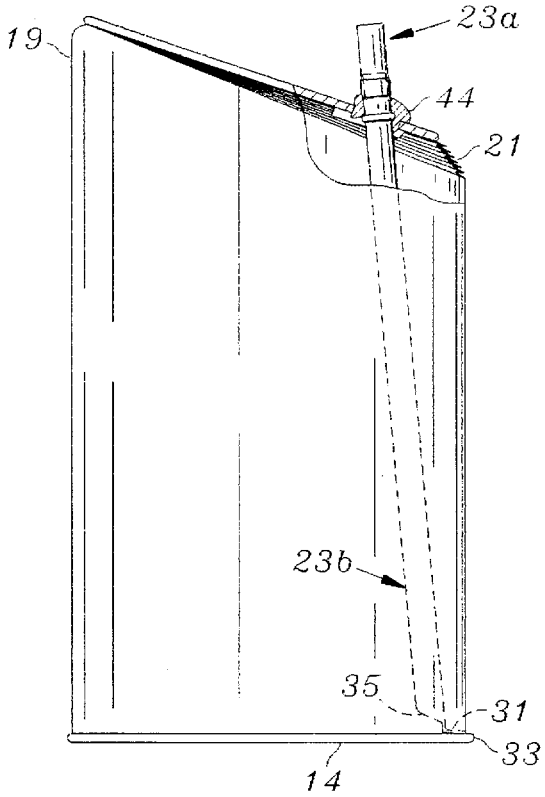
FIG. 7 is a partial cut-away side view of the container of FIG. 3 taken from line 4—4, illustrating the container after collapsing with the straw extending through the opening in the top of the container.

In use, once the straw 22 is moved to position B, the consumer manually manipulates the container 10 near the corrugated portion 20 by grasping the cylindrical container side 12 with two hands and placing both thumbs on the container top 16 above the corrugated portion 20, but away from the opening 24. The thumbs could then be used to exert the manual pressure necessary to collapse the container 10. The opening 24 should not be blocked by the hands of the consumer so that the straw 22 can freely penetrate therethrough and become exposed above the container top 16. A little extra manual force is required to overcome the initial rigidity provided by the corrugations 21. Thereafter, the corrugations 21 permit the container 10 to be readily collapsed in a downwardly inclined fashion, as illustrated in FIGS. 2 and 7.

As the container top 16, above the corrugated portion 20, moves downwardly, the upper portion **23*a* of the straw 22 comes into contact with the weakened cover 26 of the opening 24, thus causing the cover to fail. The straw 22 engages and displaces the cover 26 and then penetrates the opening 24 and becomes exposed. FIGS. 2 and 7 illustrate the container 10 of the present invention in its collapsed state in which the upper portion of the straw 22 is exposed beyond the container top surface 16. Yet another aspect of this invention would involve the use of horizontal corrugations (not shown) formed circumferentially around the entire container 10, so that in its collapsed state, the top 16** of the can remains horizontal or flat.

It should be pointed out that the inclined nature of the corrugations 21 causes the collapsible portion 20 to follow a slight arc along the radius defined by the diameter of the container. This means that as the top surface 16 is collapsed, the container top 16 will hinge about the non-corrugated top side 19 of the container, in which case the opening 24 will shift gradually radially inward as the top is depressed. Because of the hinge tab bend 31*a*, the straw 22 continues to rotate about its lower portion 23*b* inward, as can be seen in FIGS. 6 and 7.

A sponge-like ring member 44 is positioned at the very tip of the upper portion 23*a* of the straw 22, such that when the straw penetrates the opening 24 at the top of the container 10, the sponge-like ring member fits snugly within the opening to provide a seal. The sponge-like ring member 44 prevents liquid from being spilled out between the straw 22 and the opening 24 as the corrugated portion 20 is pressed downward, and slides easily down the straw so that it remains within the opening.

Figure 5:
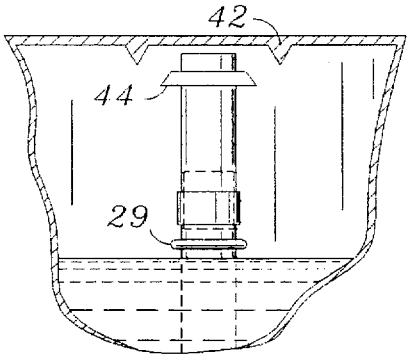
FIG. 5 is a partial cut-away view of the front of the container showing the straw of FIG. 4 taken from line 5—5.

In order to prevent the collapsed portion 20 of the container 10 from springing back upwardly toward its original position, the straw 22 is provided with a stopping mechanism illustrated in FIGS. 4 and 5. The stopping mechanism is comprised of a collar 29 mounted around the straw 22 near its upper portion 23*a* but under the sponge-like ring member 44. After the straw 22 has penetrated the opening 24 and the corrugated portion 20 is compressed to expose the upper portion 23*a* of the straw, the sponge-like ring member 44 slides down and engages the collar 29. The collar 29 then engages the sponge-like ring member 44 with the edges of the opening 24 in a friction-fit or press-fit relationship. This engagement causes the container top 16 to be held in its collapsed position, as shown in FIGS. 2 and 7, with the sponge-like ring member 44 wedged between the collar 29 and opening 24, as seen in FIG. 7. The collar 29 can be constructed from any suitable elastic material which can frictionally engage the edges of the opening 24.

As seen best in FIG. 11, the drinking straw 22 is mounted to the bottom 14 of the container 10 by the bottom tab 31 which is rigidly attached proximate and between container the lower rim 33 and side 12. Various fixing means may be used that are well known in the art. The lower portion 23*b* of the straw 22 terminates in an angled opening 35. The opening 35 is angled upward and away from the container side 12 to facilitate passage of liquids therethrough. The tab 31 is integral with the straw 22 and extends vertically downward from the lowermost portion 23*b* of the straw on the side closest to the cylindrical container side 12. The tab 31 is relatively narrow to enable it to extend vertically from the straw 22 and include the transition bend 31*a* to a horizontal mounting orientation.

In the initial configuration, shown in FIG. 4, the straw 22 is vertically disposed and extends the full length of the container 10 height from the bottom 14 to the top surface 16. The tab 31 is sufficiently strong to support nominal compressive stresses transmitted through the straw 22 from the container top surface 16. FIG. 6 shows the straw 22 in a tilted posture prior to collapsing the corrugated portion 20 of the container with the straw pivoting about the bend 31*a* in the tab 31. As the corrugated portion 20 is depressed to force the upper portion 23*a* of the straw 22 through the opening 24, the straw 22 will be tilted further due to the arcuate path followed by the opening 24, as seen in FIG. 7. The flexible bend 31*a* in the tab 31 allows this further tilt.

Figure 8:
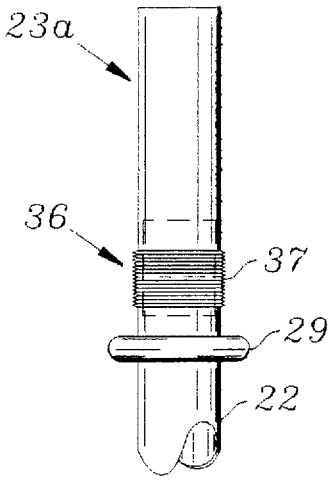
FIG. 8 is a partial view of the top end of the drinking straw in its compressed state further illustrating a stopping mechanism mounted near the upper portion thereof.
Figure 10:
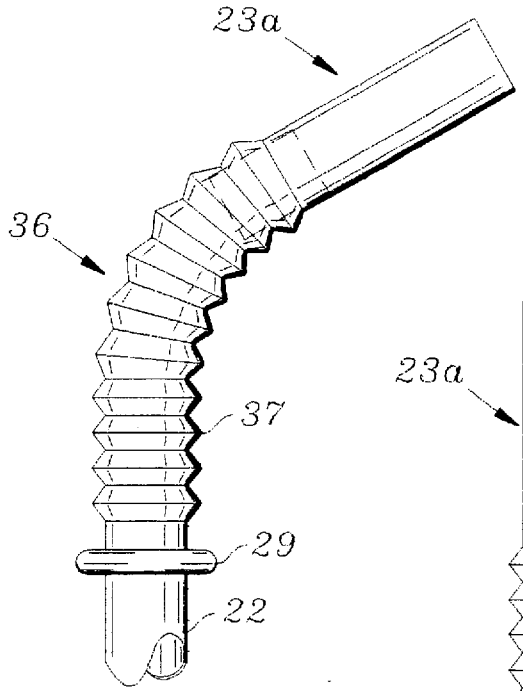
FIG. 10 is a partial view of the top end of the drinking straw in its extended and bent state.
Figure 9:
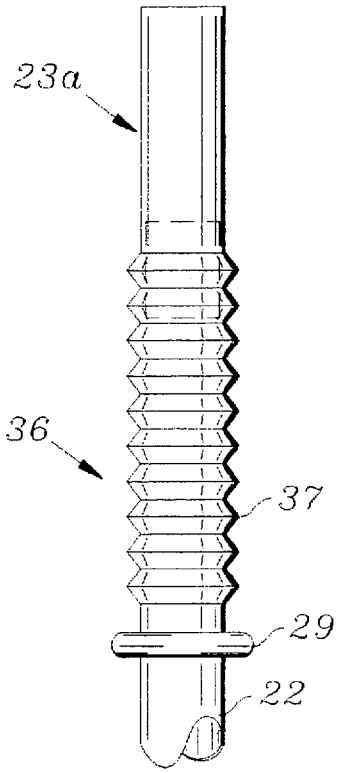
FIG. 9 is a partial view of the top end of the drinking straw in its extended state.

FIGS. 8–10 illustrate a flexible portion 36 of the drinking straw 22. Horizontal accordion-like creases 37 are disposed around the straw 22 slightly above the stopping collar 29. Initially, as seen in FIG. 8, the creases 37 are compressed to allow the straw 22 to fit inside the container 10. Upon puncture of the opening 24, the upper portion 23*a* of the straw 22 may be pulled to extend the straw by unfolding of the creases 37 (FIG. 9). A further convenience to the consumer is provided by the creases 37 which allow bending of the straw 22 toward the horizontal, as seen in FIG. 10.

The aforementioned protrusions 18 formed integrally on the exterior of the cylindrical side 12 of the container 10 may be hemispherically shaped, as shown in FIGS. 1 and 2, but can also be formed into any other shapes or configurations, including, but not limited to, stripes, diamonds, triangles, stars, animal shapes, etc., as partially shown in FIG. 4. Indeed, the protrusions can take the shape of a logo, trademark or trade name, thereby enhancing its identifiability with the consuming public.

A preferred arrangement of the protrusions 18 would concentrate a number of them in the regions of the container side 12 whereby a consumer would grasp the container and contact a plurality of protrusions, which are raised with respect to the side surface. The plurality of protrusions will enhance the ability of the user to grasp the container, the protrusions providing a gripping means to reduce the possibility providing a gripping means to reduce the possibility of slippage. Because the immersion of beverage containers in ice water or when condensation occurs in the ambient air leave smooth-sided containers wet and prone to droppage, the present invention advantageously improves the grip on the container without adding additional weight and without affixing friction-like members to the container. The raised protrusions 18 of the present invention substantially increases the traction afforded by the exterior of the sides 12 of the container 10 and leads to a reduction of the instances of dropping or spilling.

In addition, because the protrusions 18 are integrally formed on the exterior side surface 12 of the container 10 and project outward, the protrusions advantageously increase the volume within the container. Thus, an increased volume of fluids can be stored in the container 10, making each container more efficient. The volume of the container can be increased up to a full 10% or more, i.e., a 12-ounce container can be increased a full ounce or more.

The increase in volume of each container also permits the container to be manufactured slightly shorter than other conventional standard volume beverage containers. Typically, beverage containers are constructed to be collapsible and are made from aluminum. The standard container has a smooth cylindrical surface, shaped to allow a user to grasp the container easily. The container, therefore, must be of sufficiently narrow size, although the container can be made taller to provide the sufficient volume needed. Because the protrusions 18 of the present invention provide additional volume to the container, the container can be manufactured slightly shorter without increasing the width of the container, although the improved gripping of the container will allow the container to be made slightly wider than convention containers. By making each container shorter, the containers can be stacked and stored more efficiently. The shorter size of the containers can also be displayed in areas where vertical space is limited. The protrusions can also be configured such that when the containers are stored side by side, the protrusions of each adjacent container can interlock, or at least be positioned so that the containers do not take up additional space.

In the manufacturing process, the container is made of a thin sheet of metal or metal-like material, such as aluminum, which is pressed and rolled to the proper thickness. The protrusions 18 of the present invention can easily be formed on the sheets by a stamping process which pushes the protrusions 18 outward on one side and creates indentations on the other side. The protruding side will be positioned on the outer surface, to provide the improved gripping means, and the indentation side shall be provided on the inside of the container, to increase the fluid volume therein. Unlike the prior containers, made of styrofoam or glass, which must be formed by a vacuum injection process, permitting only protrusions on one side without indentations on the other side, the present invention contemplates use of materials which can physically be stamped to provide the combination of an indentation on one side and a protrusion on the other side. This manner of manufacturing can also achieve cost savings, as the volume of the container can be increased without increasing the amount of material used or the size of the container.

In addition, because the protrusions 18 project outward, the hand of the consumer will predominantly come into contact with the protrusions, without substantially touching the cylindrical side 12 of the container, which reduces the amount of surface area contact between the user's hand and the container side. By reducing the contact surface area between the user's hand and container 10, and isolating the contact to the protrusions 18 only, a decrease in conductive heat transfer from the hand of the consumer to the container, and vice versa, can be achieved. The beverage in the container 10 of the present invention thus remains colder longer, while the consumer experiences less discomfort when handling extremely cold containers.

A further advantage of the protrusions 18 is that they can be shaped and arranged to convey any message to consumers. The exterior side surface 12 of the container 10 can be designed with various shapes which can be incorporated into the trademark or trade dress of the product. Each protrusion 18 can be colored with patterns or designs or made into a texture to make the container 10 aesthetically distinct and recognizable. One incidental benefit of having the protrusions 18 is that they may also convey particular messages to the blind. Various messages can be placed on containers which can be identified by the blind, such as, for instance, containers containing toxic substances, etc.

The protrusions 18 on the side of the container also provide additional strength to the container. The protrusions 18 can be configured into shapes, including ribs, to provide structural rigidity to the container, which permits the containers to be stacked more readily.

In the embodiments of FIGS. 12 to 16 there are shown configurations of the can with different embossing on the surface. In FIGS. 12 to 15 the embossing of a recognizable form is effected on a thin gauge collapsible aluminum can of relatively standard dimensions in height relative to diameter for a conventional beverage can, for instance, for dispensing cool drinks such as a soda. Such a can is crushable under the action of finger pressure when there is no fluid present in the interior of the can.

The size of such a standard volume can for 12 fluid ounces would be a height of about 5 inches and a diameter of about 2.5 inches, namely a ratio of about 2:1 between the height and the diameter. In these embodiments, the embossed effect allows the contents of the same overall size can to be increased in volume so that, for instance, an extra 0.5 to 1 fluid ounce of liquid can be contained in the can. This would depend on the number of protrusions and the overall depth of the protrusions from the basic surface of the can.

Figure 16:
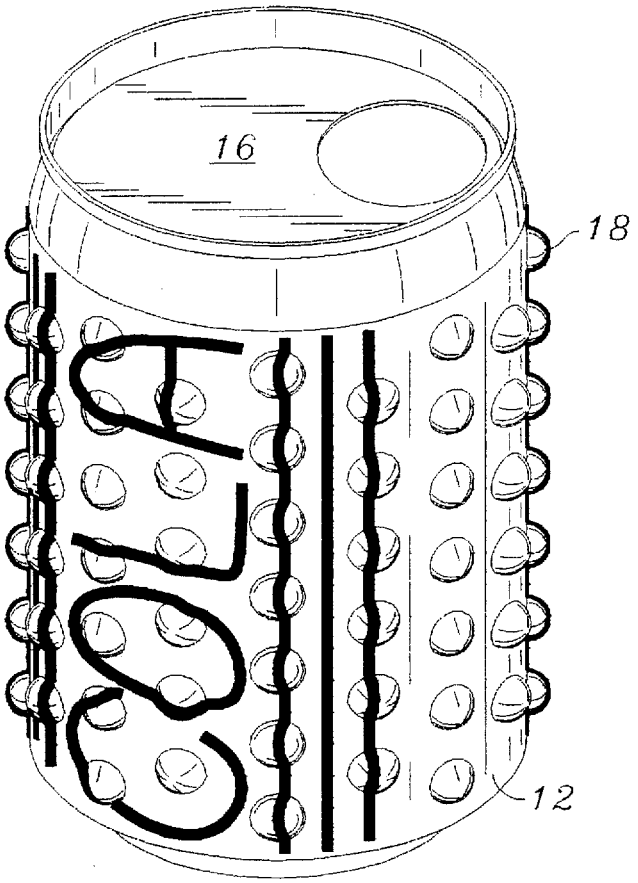
FIG. 16 is front view showing a can with a logo printed and embossed on the surface of a can which is relatively shorter in height and with a larger diameter than a standard size can.

In the embodiment illustrated in FIG. 16, the can illustrated is relatively squatter, namely the can is made shorter in height and larger in diameter. As such the can may have a height of about 4.5 inches and diameter of about 2.5 inches to contain the same 12 ounces of liquid. In such a manner, the ratio of the height to the diameter can change top be less than about 2:1. Alternatively the dimensions can change to form a can of a different structure wherein the ratio of the height to the diameter changes to less than 2:1 to about 1:1.

By having a can of the greater diameter and less height, and with the protrusions, there is less of the contents of the can which is exposed to contact with the hand of a user, particularly where the hand of the user contacts essentially only the protrusions about the surface. Less of the fluid content of the can is in potential contact with the surface of the inner surface of the can. Thus, less heat transmission through the material is effected by the contact with the outside opposite surface through the hand. There is, thus, less possibility for conduction of heat from the hand to penetrate through the surface into the fluid, and cause an undesirable warming of the fluid. There is less likelihood of temperature conduction between the hand and the contents of the can.

In the can of FIG. 16, there is shown a printed layer on the surface of the can of the lettering of a trademark. These letters and representations rise and fall relative to the overall flat surface of the can. In this manner, the printed lettering forms a generally three-dimensional effect which substantially enhances the can. A similar effect is achieved with the repeating art work designs and logo that are printed and embossed onto the can surface in the embodiments having the protrusions. Such artwork can also have a printed layer on the surface of different coloring over the protrusions to enhance the can.

In another embodiment of the present invention, the drinking straw can be replaced by a funnel or pour spout (not shown). Such a funnel or spout can be utilized to dispense a wide variety of fluids, as well as other materials, for consumer or industrial use. As the container is collapsed in the same fashion described above, the top of the funnel or spout comes into contact with the weakened opening (not shown) of the container top, thus causing the funnel or spout to be exposed. The funnel or spout is also provided with a collar or stopping mechanism for holding the container top in its collapsed state.

It should also be pointed out in connection with this invention that the relative strength and rigidity of the container 10, its corrugated portion 20, and the opening 24 can be adjusted to accommodate different container materials and fluids. For example, in certain applications, it may be preferable for the top portion 23*a* of the straw 22 or spout to form its own opening 24 by perforating the top surface 16 of the container 10 which surface is completely comprised of a weakened material such as paper or cellophane. Thus, it may not be necessary to have a discrete perforated opening 24, as described above.

As shown in FIGS. 17 and 18 the first body portion 100 is contained within a cylindrically shaped container as formed by a second body portion shirt 101. The first portion 100 is formed of a plastic sheeting material which can be blow molded or formed within the second body portion 101. The second body portion 101 is made of a thin gauge aluminum material which is crushable under finger pressure when there is no fluid or the like within the body 102 of the container. The second body portion 101 contains at spaced intervals apertures 103 along the surface 104 of the second body portion 101. The apertures 103 can be spaced circumferentially around the surface of the second body portion 101.

By forming the first body portion 100 inside of the second body portion 101, and filling the container with its contents, protrusions 105 are formed to extend outwardly from the surface 104 of the second body portion 101. The protrusions 105 can form any geometric shape that is desired.

As illustrated in FIG. 17, there are hemispherical type bubbles as shown on the left hand side of the body portions of the figure. On the right hand side of the figure the portions are formed so that the protrusion 105 have an irregular shape.

A suitable laminating process can be provided to effectively adhere the first body portion 100 with the second body portion 101. Although illustrated in FIG. 18 to be a collapsible can, the can may not be collapsible in either the first body portion or second body portion and likewise there may not be a straw 22 within the can. The can may simply be collapsible under the pressure of a hand or finger when the contents are no longer within the can.

By having the second body portion 101 formed in this manner, there can be about 50% of the surface 104 of the second body portion 101 provided with spaces for the apertures through which the first body portion 100 can project. In this manner, the second body portion would need to constitute about 50% of the material normally used in a can with only a single body portion for the can.

With the invention there can thus be a relative reduction of the amount of material constituting the second body portion 101. In turn, plastic or the like which may be relatively less expensive can be provided as the first body portion 100 and it can effectively constitute the fluid tight seal for the fluid within the can. The second body portion 101 thus acts as a shirt to provide rigidity to the plastic effectively forming the container. As such, a relatively thin gauge plastic material can constitute the first body portion 100 for the container for the fluid, and the outer second body portion 101 would provide sufficient rigidity to that container.

As illustrated in FIG. 18, the protrusions 105 form straight angulated formations with an apex 106 for each of the protrusions 105. In FIG. 17 the curved formations provide the hemispherically type protrusion shapes 105.

The cutout aperture formations in the surface 104 of the second body portion 101 can be shaped to any desired form so that different shapes of protrusions can extend beyond the surface 104 of the second body portion 101. The protrusions can form an array arranged axially and circumferentially about or around the container.

In different forms of the invention, different combinations of materials can constitute the first body portion and second body portion.

In the arrangements illustrated in the above Figures where the protrusions are spherical or are like a bubble 105 it is desirable that a radius for the bubble is in the range between 0.05 to 0.020 inches, and preferably about 0.15 inches. The same size of bubble should be provided to the embodiments of the invention as illustrated where the bubble is used on the side wall of the container as illustrated in situations, for instance in FIGS. 1 and 2. This will ensure that there will be effective strength in the can.

The present invention provides a simple, yet reliable method for providing an enhanced container using multiple materials. By having the materials selected in the nature to be most economical and environmentally advantageous an effectively desirable container is provided. The first body portion 100 can selectively be formed from a synthetic resinous, plastic, cellulose such as a paper or board material, or a metallic material. The second body portion 101 can be formed from a synthetic resinous, plastic, cellulose or a metallic material. In some situations the second body portion may be formed of a foam material or paper. This can provide the additional advantages of providing an insulation affect for the container. In yet other forms the materials for either one of the body portions may be a paper or board. Different degrees of visibility or clarity can be provided to the first body portion and the second body portion.

Many other forms of the invention can be provided. The shape of the container can be a regular cylinder form, square or the like. It could have a neck with a screw or interlocking top, cover or cap for the closure in or with the top portion. The laminated container of the invention can provide hygienic advantages, and avoid internal protective coating usually used in cans. Different methods can be used for laminating the first body portion and the second body portion. There can be a heat or pressure sealing or other interlocking system. In other situations the first body portion and the second body portion are relatively loose. Thus when there is no fluid in the container the body portions may be separable.

Figure 20A:
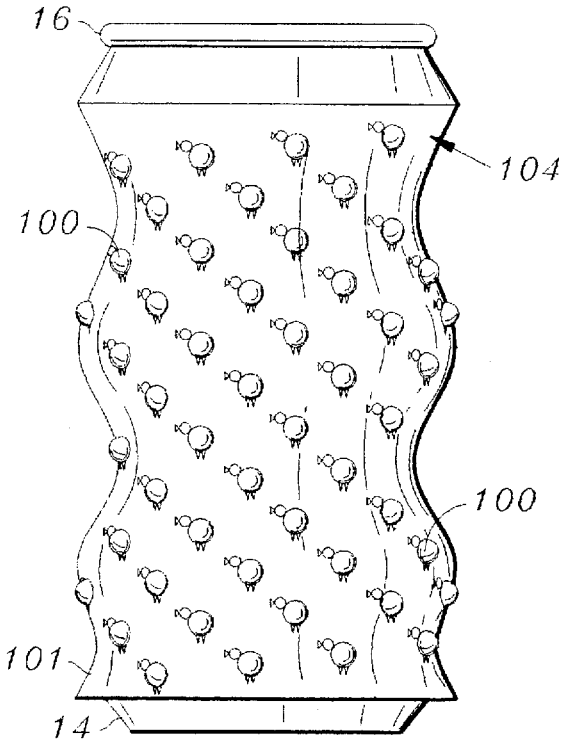
Figure 20B:
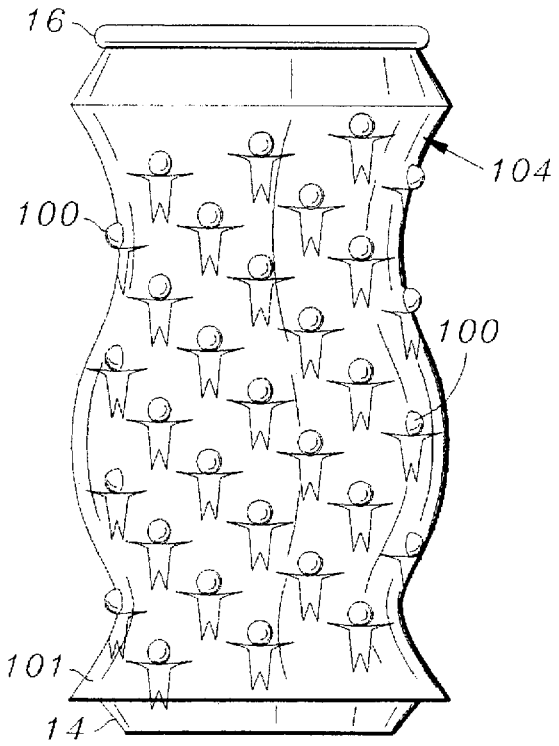
Figure 20C:
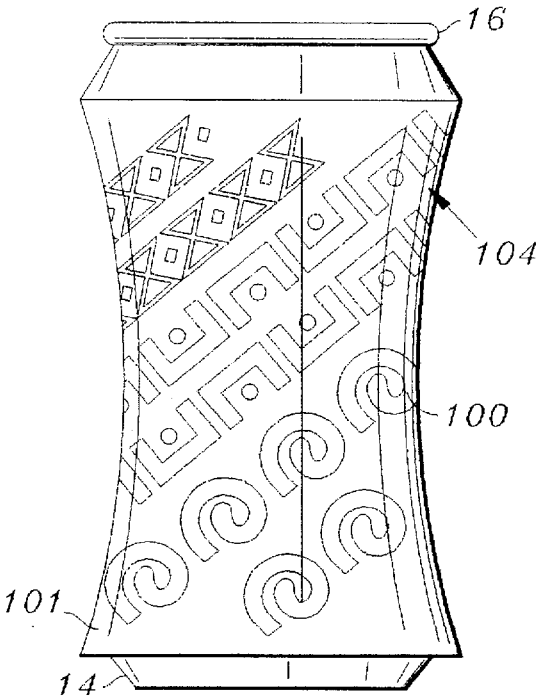
Figure 20D:
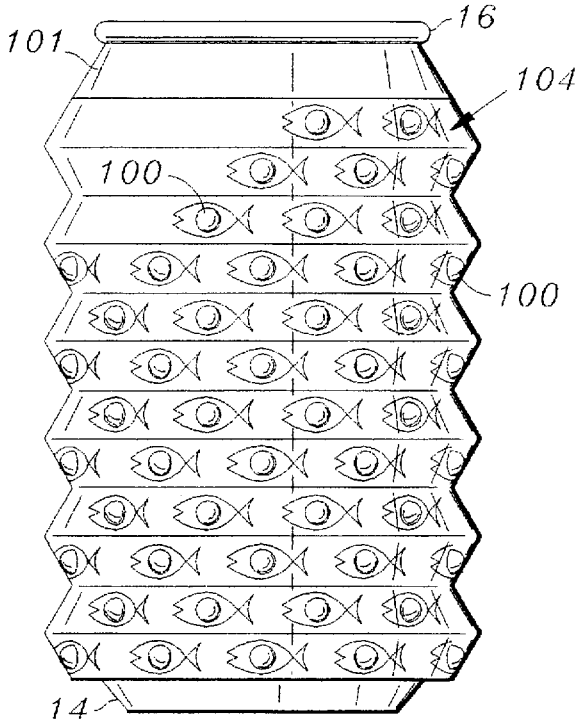

In the embodiments of the invention illustrated in FIGS. 20A to 20D there are shown situations where different corrugation profiles are provided to the second body portion 101. In FIG. 20A the corrugations are a regular sinuous form about the perimeter of the can. In FIG. 20B the sinuous form is irregular in the sense that the format is angulated. In FIG. 20C the body portion 101 is curved inwardly in the center to form a waist line. In FIG. 20D there is angulated saw tooth pattern for the body portion 101.

On the face of the body portion 101 there are apertures 103 through which the first body portion is visible. The apertures 103 can have different artistic shapes, for instance, a sheep, a human figure, an abstract shape, or a fish as shown in the FIGS. 20A to 20D respectively. The first body portion 100 inside the second body portion 101 can protrude beyond the surface of the second body portion 101, or be flush against the inside surface of the second body portion 101. By having the first body portion formed of a material which is at least partly translucent the contents of the can be seen as required. There are different embodiments where it would be desirable for the first body potion 100 to be contained wholly within the second body portion 101. In other situations the first body portion can extend as protrusions through at least some of the apertures.

In other forms of the invention the cross section of the containers of the invention when viewed from the top of bottom may be different to cylindrical. Thus the cross-sectional shape may be triangular, rectangular, square, oval, or any other polygonal shape. These views are shown respectively in FIGS. 21 to 25. The container may also be a conventional bottle type shape, namely with a narrow neck.

In some cases the second body portion does not extend to fully cover the first body portion. In such situations the first body portion could be made of different strengths and thickness over its surface so as that in the areas where there is only the first body portion, that body portion is sufficiently strong to hold the contents of the container.

The overall rigidity to the can be provided by a combination of the first and second body portions or by either one of the body portions. In some cases the second body portion is essentially ornamental and provides little of the structural strength to the can. The first body portion and the second body portion can be joined by a suitable heating or vacuum forming process.

In different aspects of the container of the invention, the container can be for holding different contents and fluids. The thickness and strength of the walls of the first and second body portions respectively can be established according to the weight to be held by the container.

In other forms of the invention as shown in FIG. 21 there can be protrusions on the surface of the second body in addition to the apertures in the surface of the second body. In this manner there is a combination of protrusions provided by both the first body portion and the second body portion. In some cases the first body portion acts as an internal type vest and the second outer body portion is the container for the fluid.

The invention is to be determined in terms of the following claims.

What is claimed is:

1. A container comprising:

an elongated substantially rigid body portion forming a side wall and having first and second ends, the portion having multiple apertures spaced about the side wall, the apertures being spaced on the side wall between the top and the bottom;

a body portion being formed of a thin generally flexible synthetic resinous material and having a first and a second end the synthetic resinous material portion being an inner wall to the rigid portion, the rigid body portion and the synthetic resinous body portion being press laminated together to form an integral relationship;

a bottom sealing said first end of the rigid body portion;

a top sealing said second end of the synthetic resinous body portion to provide a closed cavity suitable for containing a fluid;

the body portions providing collectively a pattern of protrusions of a preselected shape, height, and configuration, the respective protrusions being generally separately located from each other and integrally connected with each other by the side wall to form an array arranged axially and about the container; and the synthetic resinous body portion having protruding shapes constituting protrusions which extend through the apertures in the rigid body portion.

2. A container as claimed in claim 1, wherein the protrusions are a shape selected to be at least one of repetitive triangle, star, rectangle, circle and other recognizable structural form.

3. A container as claimed in claim 1 wherein the rigid body portion includes an outside surface, and including a printed layer of an ornamental representation on the outside surface, the ornamental representation extending selectively at least in part over the protrusions thereby to enhance the ornamental effect of the surface, and wherein the ornamentation selectively includes printed lettering, and wherein the rigid body portion additionally includes protrusions extending from the outside surface.

4. A container as claimed in claim 1 wherein the rigid body portion includes an outside surface, and including a printed layer of an ornamental representation on the outside surface, the ornamental representation extending selectively at least in part over the protrusions thereby to enhance the ornamental effect of the surface, and wherein the rigid body portion additionally includes protrusions extending from the outside surface.

5. A container as claimed in claim 4 wherein the ornamentation includes lettering.

6. A container as claimed in claim 1 wherein the protrusions selectively have a shape with at least one of curves and straight faces, such protrusions extending beyond an outer surface of the rigid body portion.

7. A container as claimed in claim 1 wherein the pattern of protrusions extend to about 50% of a surface of the rigid body portion.

8. A container as claimed in claim 1 wherein the side walls and bottom are an integrated element.

9. A container as claimed in claim 1 wherein the multiple apertures are generally formed as a network about the surface.

10. A container as claimed in claim 1 wherein the flexible synthetic material is substantially translucent.

11. A container for a fluid comprising;

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a pattern of protrusions of a preselected shape, height, and configuration the protrusions enhancing the exterior periphery of the body portion by providing traction thereto, the protrusions extending outwardly to increase the volume of container relative to the same container without embossing; and the body including an outside surface, and including a printed layer of an ornamental representation on the outside surface, the ornamental representation acting to enhance the ornamental effect of the surface, and the ornamental representation including in at least some part printed lettering, and at least some part of the ornamental representation extending over the protrusions.

12. A container as claimed in claim 11 wherein the protrusions define a waist line.

13. A container as claimed in claim 12 wherein the body is formed of a aluminum thin gauge material, the material being selectively crushable under finger pressure when the container is empty, and the body of the container being formed with protrusions by a stamping process.

14. A container as claimed in claim 11 wherein the body is formed of a aluminum thin gauge material, the material being selectively crushable under finger pressure when the container is empty, and the body of the container being formed with protrusions by a stamping process.

15. A container for a fluid, comprising:

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a profile of a preselected shape, height, configuration and arrangement, the profile enhancing the exterior periphery of the body portion by providing traction thereto, the profile extending relatively inwardly relative to the same container with a smooth surface and without the embossed profile;

the body including an outside surface, and including a printed layer of an ornamental representation on the outside surface, the ornamental representation acting to enhance the ornamental effect of the surface, and the ornamental representation including in at least some part printed lettering, and at least some part of the ornamental representation extending over the profile.

16. A container as claimed in claim 15 wherein the profile defines a waist line.

17. A container as claimed in claim 16 wherein the body is formed of a aluminum thin gauge material, the material being selectively crushable under finger pressure when the container is empty, and the body of the container being formed with protrusions by a stamping process.

18. A container as claimed in claim 15 wherein the body is formed of a aluminum thin gauge material, the material being selectively crushable under finger pressure when the container is empty, and the body of the container being formed with protrusions by a stamping process.

* * * * *

UNITED STATES PATENT AND TRADEMARK OFFICE

CERTIFICATE OF CORRECTION

PATENT NO. : 5,762,230

DATED : June 9, 1998

INVENTOR(S) : Nini Policappelli

It is certified that error appears in the above-identified patent and that said Letters Patent is hereby corrected as shown below:

At page 4, line 24, please replace "50" with —50%—.

At page 5, line 25, please delete "and" after "material".

At page 11, line 2, please replace "cross sectional" with —cross–sectional—.

At page 16, line 20, please replace "container the lower rim" with —the container lower rim—.

At page 18, lines 8 and 9, please delete "providing a gripping means to reduce the possibility" after the word "possibility".

At page 21, line 34, please replace "top be less" with —top to be less—.

At page 27, line 19, please insert —will— after the word "can".

At page 27, 28, please replace "of bottom" with —of the bottom—..

Signed and Sealed this

Sixth Day of April, 1999

*Attest:*

Q. TODD DICKINSON

*Attesting Officer*

*Acting Commissioner of Patents and Trademarks*